US005205015A

United States Patent [19]

Huang

[11] Patent Number: 5,205,015

[45] Date of Patent: Apr. 27, 1993

[54] DOOR HINGE WITH AUTOMATIC RETURNING MEANS

[76] Inventor: Hao-Tang Huang, 12-2, Lane 771, Shin Juang Rd., Shin Juang City, Taipei, Taiwan

[21] Appl. No.: 870,254

[22] Filed: Apr. 17, 1992

[51] Int. Cl.[5] ..... E05F 5/08; E05C 17/00

[52] U.S. Cl. ..... 16/50; 16/319; 16/303; 16/307; 16/297

[58] Field of Search ..... 16/284, 285, 297, 303-305, 16/307, 319, 50, 54, DIG. 10, DIG. 17

[56] References Cited

U.S. PATENT DOCUMENTS

| | | | |
|---|---|---|---|
| 583,536 | 6/1897 | Masters | 16/303 |
| 1,134,510 | 4/1915 | Busch | 16/50 |
| 3,537,126 | 11/1970 | Nakanishi | 16/50 |
| 4,485,522 | 12/1984 | Chen | 16/303 |

*Primary Examiner*—Lowell A. Larson
*Assistant Examiner*—Donald M. Gurley
*Attorney, Agent, or Firm*—Morton J. Rosenberg; David I. Klein

[57] ABSTRACT

A door hinge with automatic returning means composed of; a male hinge member (1), a female hinge member (2), an inner sleeve (3), a transmission rod (4), main spring (5), a driving element (6), a buffer spring (7) and a retainer (8), in which, the male and female hinge members will take an angle of rotation in anti-clockwise when the door is proceeding to its open position, and in turn to effect the driving element and transmission rod to rotate in synchronized operation respectively. When the movement for driving element is being effected through a helical motion of external/internal thread engagement, and with the restraint imposed onto this element by outer sleeve of female hinge member, this element will move upward to press the main spring to retract. When door is released by operator it also released the pressure on main spring, and this released pressure will push the driving element to move downward and in turn to rotate the transmission rod as well as the male hinge member in clockwise direction for an equivalent amount of angle unit the door returned to its closed position automatically.

2 Claims, 2 Drawing Sheets

DOOR HINGE WITH AUTOMATIC RETURNING MEANS

TECHNICAL FIELD

This invention relates to a door hinge and particularly to a door hinge with automatic returning device which can bring the door back to its closed position after its opening.

BACKGROUND ART

General design for a door hinges in the prior art merely has the functions for the door to be pivotly jointed and supported on a fixed door frame and the hinge itself does not have the capability to bring the door back to its closed position automaticly after it has opened for a passage. Therefore, in most places such as air-conditioning room and VIP's office has to trouble the person who came in/out to close it by hand in order to keep the door to be closed for privacy and maintaining room temperature. Although, one type of door hinge used on screen door in the early days provided with an inner expansion spring to preform automatic returning function, however, the returning force is created by spring expansion and repeat expansion is tend to cause damage to the spring. Experience in using this type of hinge indicated that a short period of its usage, the hinge will start to making noise when door is operating and followed by gradually lossing of its strength and finally lead to its total failure. In fact, this type of hinge is definitely not suitable to be used on ordinary office/-room doors.

Based on the above, the present invention provide a door hinge with automatic returning means which can be widely used on all kinds of doors and windows etc.. The main purpose of this design is to give a further function for automatic returning in addition to a hinge's basic characters as well as to eliminate all the drawbacks which happened on that particular type of hinge used on screen door in early days.

The further object of the present invention is to design a automatic returning device which will achieve the purpose for the door to "open fast and slow to close" by having a buffer spring fitted on the lower portion of driving element.

Additional, a butterfly screw is located on the outer sleeve which can be screwed in transversely to urge against the driving element to disable the rotation of both male and female hinge members when a door's fixed position is desired for temporary purposes.

BRIEF DESCRIPTION OF THE DRAWINGS

The accompanying drawings, which are incorporated in and constitute a part of the specification, illustrate the presently preferred embodiments of the invention and, together with the description, serve to explain the principle of the invention.

PREFERRED EMBODIMENT OF THE INVENTION

Figure 1:
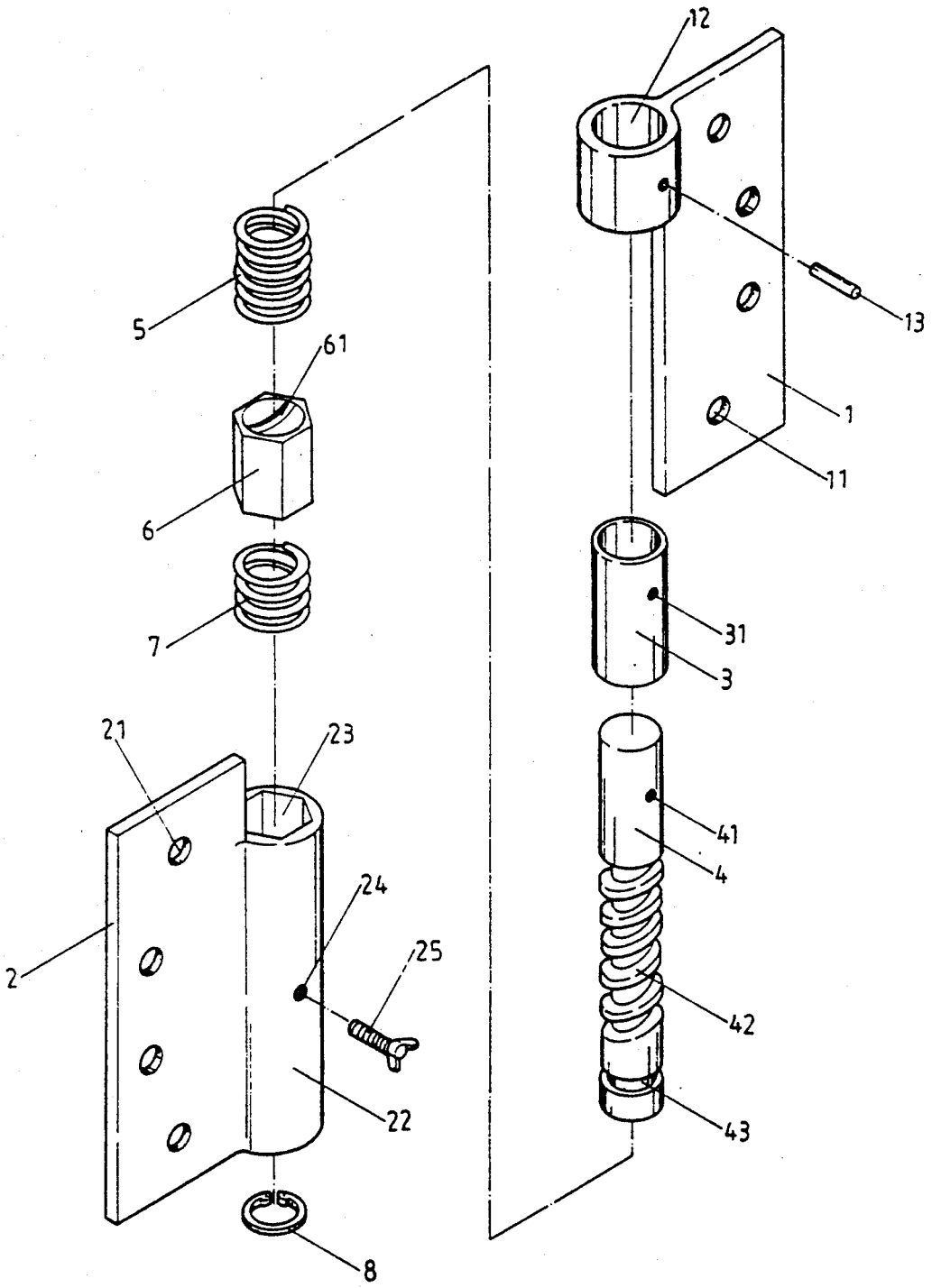
FIG. 1 is an exploded view showing the construction of the present invention.

Reference is made to accompanied drawings in which the invention as an integrated unit, is comprising:

a male hinge member (1), a female hinge member (2), an inner sleeve (3), transmission rod (4), main spring (5), driving element (6), a buffer spring (7) and a retainer (8).

On the flat surface of male hinge member (1) is formed with a plurality of holes for securing this hinge member to a door wing with screws. A hollow annular element (12) is projected form the upper inner side of flat surface, on which, pin hole is formed for a pin (13) to passing through.

On the flat surface of female hinge member (2) is also formed with a plurality of holes for securing it to a door frame with screw. An outer sleeve (22) projected from middle and lower inner side of flat surface and the outer diameter of which is in corresponding to that of hollow annular element of male hinge member (1), so that, when these two hinge members is in assembled state, these two projections will be in vertical alignment with each other and the length of these two projection shall be equivlent to the length of each hinge member. Moreover, the inside of this outer sleeve preferablly be a hollow channel in regular polygen shape (hexagon hollow channel (23) shown in FIG. 1) in order to be fitted with a driving element (6) of the same shape.

The inner sleeve (3) is inserted into annular element of male hinge member (1) with its upper half and inserted into outer sleeve of female hinge member (2) with its lower half. A pin hole (31) also provided on the upper half of this inner sleeve and shall be placed in alignment with the hole on annular element for pin (13) to passing through so as to hold the inner sleeve in place together with transmission rod (4).

Transmission rod (4) is in circular cylinder shape with its upper end inserted into inner sleeve (3). A pin hole (41) is also formed on its upper portion which again shall be in alignment with pin holes on both inner sleeve and annular element, so that, when pin (13) is inserted right through these three holes, these three units —the annular element of male hinge member (1), the inner sleeve (3) and the transmission rod (4) —shall be firmly connected as one moving mechanism. It is important to note that an external thread is provided around the outer surface of this rod which shall be engaged with internal thread of driving element to constitute one of two key factors for driving the element upward and downward. Also, a retainer groove (43) is formed at the lower end of transmission rod to accommodate the retainer (8).

The main spring (5) envelop the transmission rod (4) with its upper end urge against the bottom of inner sleeve (3) and its lower end press against the top surface of driving element (6).

The driving element (6) is configurated in corresponding to the shape of hollow channel (23) of outer sleeve (22). In case of the embodiment showing in FIG. 1, the shape of this driving element shall be hexagon, and the size of which shall be a little small than that of hollow channel (23), so that, it can be loosely fitted with one envelop the other. Furthermore, the inside of this driving element is also a hollow channel in circular shape, around its surface, as mentioned above, is provided with an internal thread (61) which is to be engaged with the external thread (42) of transmission rod (4) to produce a helical motion.

Same as the main spring (5), the buffer spring (7) also enveloped the transmission rod (4) at its lower portion. The upper end of buffer spring (7) is urge against the bottom of driving element (6) and its lower end is contacted and supported by retainer (8).

Retainer (8) is located at lower end of outer sleeve (22) and shall be accommodated within the retainer groove (43) of transmission rod (4) when the later is extended through main spring (5), driving element (6), buffer spring (7) and further to the lower end of outer sleeve (22). When this engagement is made, the whole door hinge is completely assembled as one integrated unit as shown in FIG. 2.

Figure 2:
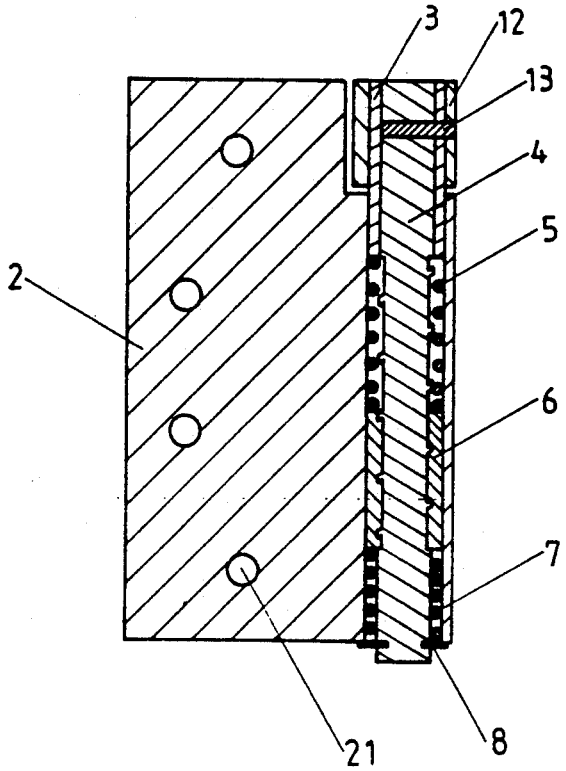
FIG. 2 is a sectional view showing the door hinge of the present invention in its closed position.
Figure 3:
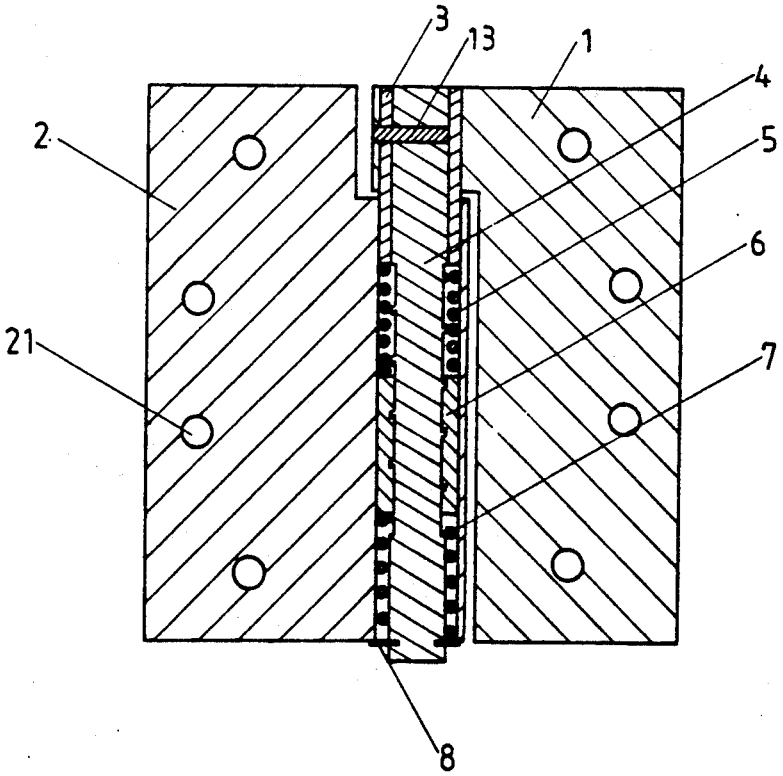
FIG. 3 is a sectional view showing the door hinge of the present invention in its opened position.

The automatic returning function of door hinge of the present invention can be best seen in FIGS. 2 and 3. FIG. 2 shows the door is in its closed position and the main spring (5) is in normal loosing state; However, when the door is open to the right direction, the male hinge member (1) (secured to the door wing) will rotate in clockwise direction together with inner sleeve (3) and transmission rod (4) for amount of angle distance in corresponding to how wide the door is opened; Since the driving element is restrained within the outer sleeve (22) of female hinge member (2), it shall not be able to rotate with the transmission rod (4) and consequently a linear motion as a result of angle of rotation is thus occurred between driving element (6) and transmission rod (4). At this moment, the driving element shall be effected by the rotation of transmission rod through a helical motion from external/ internal thread engagement and with the restraint imposed by outer sleeve of female hinge member (2), this driving element is to move upward as showing in FIG. 3. Because of this upward driving from this element to the main spring, this main spring (5) shall be retracted under pressure to some extent, so that, when door is released by operator, the driving element shall be no longer to urge against the main spring (5) and the released pressure from this main spring (5) shall press the driving element (6) to move downward; the downward displacement of this driving element will cause the transmission rod (4) to rotate in counter-clockwise direction so as to bring the male hinge member (1) and door wing return to its closed position as showing in FIG. 2. Again, at this moment the main spring (5) is recovered to its loosing state and door wing shall not to rotate.

As is evident from the foregoing, the automatic returning function of the present invention is made by utilizing the transmission rod (4) and driving element (6) to produce the same angle of rotation as drived by male (1) and female (2) hinge members respectively while the later two is rotating in angle variety, and when the driving element (6) is moving in upward displacement, it urge the main spring (5) to retract, later when this main spring is no longer under pressure, this released pressure will push the driving element (6) for downward displacement so as to rotating the transmission rod (4), inner sleeve (3) and male hinge member (1) in counter-clockwise direction for same amount of angle distance and bring the door return to its closed position automaticly.

Additionally, a buffer spring (7) is provided at the lower end of the driving element (6) for producing a buffer effect against downward displacement of driving element so as to achieve the purpose of "QUICK TO OPEN AND SLOW TO CLOSE". As discussed above, when door is open, the driving element (6) is moving upward through helical motion of external/internal thread, the buffer spring (7) at this moment, is tend to push the driving element (6) in upward direction at its lower end. When door is returning to its closed position the driving element (6) is moving in downward direction, the buffer spring (7) at this moment, is tend to resist this downward motion so as to creat a resistance force to the clockwise rotation of transmission rod until the downward motion gradually overcomed the resistance force. This is how the purpose of "QUICK TO OPEN AND SLOW TO CLOSE" to be achieved.

In addition, at the intermediate location of outer sleeve (22), a screw aperture (24) is being provided, through which, a butterfly screw can be screwed to the inside to press against driving element (6) as well as to disable its up and down displacement and in turn the male and female hinge members as well. Therefore, this could be served as another form of locking means to secure the door in a fixed position for temporary purpose, such as it is desired to keep the door open when too many in/out is expected as sell as to keep it closed as not wish to be disturbed.

It should be noted that the hinges with automatic returning function used on traditional screen door is obtained by simply using an expansion spring which subjected to a very short operation life. On the other hand, the pressure imposed onto the main spring of the present invention is made through a well arranged mechanism and the spring is well housed in sleeve which made no possibility to be bended or twisted by actions of door's open and close.

While a preferred embodiment of the present invention have been shown and described, it will be obvious to those skilled in the art that changes and modifications may be made with out departing from the invention in its boarder aspect, for example: the inner shape of outer sleeve and driving element could be any king of polygon. Therefore, the aim in the appended claims is to cover all such changes and modifications as fall within the true spirit and scope of the invention.

What the claim is:

1. A door hinge with automatic returning means is comprising a male hinge member, a female hinge member, an inner sleeve, a transmission rod, main spring, a driving element, a buffer spring and a retainer, in which:

a hollow annular element is provided at inner side of flat surface of male hinge member, on which is formed with a pin hole; a outer sleeve is also provided at the inner side of flat surface of the female hinge member and the outer diameter of which is in match with the annular element: inside of this outer sleeve is a channel in polygon shape and configurate to accommodate a driving element of same polygon shape in loose fit; an inner sleeve is inserted into outer sleeve with its lower portion and inserted into annular member with its upper portion, on which a pin hole is also formed in alignment with the pin hole of annular member; the transmission rod is cylinder in shape and the upper end of which is housed in inner sleeve with a pin to pierce through the holes of annular member, the inner sleeve and hole on the upper portion of this rod, all these parts—the annular member, the inner sleeve and transmission rod—shall be connected as one moving unit, an external thread is provided around the intermediate portion of this rod and a retainer groove is formed at its lower end; the main spring enveloped transmission rod with its upper end urge against the bottom of inner sleeve and its lower end contacted the top surface of driving element: the driving element is accommodated within the outer sleeve with its outer diameter in same configuration with the inner diameter of outer sleeve but little less sized, so that, it can be housed in outer sleeve in loose fit, the inner shape of driving element is a circular hollow channel, on which an internal thread is provided which shall be engaged with above mentioned external thread so as to produce a helical motion; the buffer spring also enveloped the transmission rod with its upper end urge against the bottom of driving element and with its lower end contacted and supported by retainer; and the retainer is engaged with retainer groove which is formed at the lower end of transmission rod in the portion extended further from outer sleeve.

2. A door hinge with automatic returning means as in claim 1, in which, a butterfly screw is provided at intermediate portion of outer sleeve which can be screwed transversely to the inside of outer sleeve to press against the driving element and disable its up and down movement, and in turn to control the orientation of male and female hinge members not to make any angle of rotation.

* * * * *